US006334825B1

(12) United States Patent
Buiatti

(10) Patent No.: US 6,334,825 B1
(45) Date of Patent: Jan. 1, 2002

(54) END CAP ASSEMBLY FOR THIN WALL METAL BALL BATS

(75) Inventor: John Buiatti, Van Nuys, CA (US)

(73) Assignee: Jas D. Easton, Inc., Van Nuys, CA (US)

( * ) Notice: Subject to any disclaimer, the term of this patent is extended or adjusted under 35 U.S.C. 154(b) by 49 days.

(21) Appl. No.: 09/585,234

(22) Filed: May 31, 2000

(51) Int. Cl.[7] ..... A63B 59/06
(52) U.S. Cl. ..... 473/566
(58) Field of Search ..... 473/564–568, 473/519, 520, 457

(56) References Cited

U.S. PATENT DOCUMENTS 3,703,290 A * 11/1972 Wilson ..... 473/566
3,727,295 A * 4/1973 Gildemeister ..... 473/566
3,876,204 A * 4/1975 Moore et al. ..... 473/566
4,274,631 A * 6/1981 Hayazaki ..... 473/457
4,720,104 A * 1/1988 DiSieno ..... 473/566
5,785,617 A * 7/1998 MacKay, Jr. ..... 473/566
5,931,750 A * 8/1999 MacKay, Jr. ..... 473/566
5,954,602 A * 9/1999 Eggiman et al. ..... 473/566
5,964,673 A * 10/1999 Mackay, Jr. ..... 473/566
6,152,840 A * 11/2000 Baum ..... 473/564

* cited by examiner

*Primary Examiner*—Mark S. Graham
(74) *Attorney, Agent, or Firm*—Roth & Goldman

(57) ABSTRACT

An end cap assembly for a thin wall tubular ball bat includes an insert sleeve which is closely received inside the barrel end of the bat and defines, with the barrel, a glue chamber into which adhesive is injected to affix the sleeve to the barrel without a mechanical interlock. The end cap is mechanically locked into the sleeve and held in place by a radially projecting locking collar on an axially depending skirt portion of the end cap which is received in an annular recess in the internal cylindrical surface of the sleeve. Abutting shoulders on the end cap and sleeve prevent axial movement of the end cap relative to the sleeve.

11 Claims, 1 Drawing Sheet

END CAP ASSEMBLY FOR THIN WALL METAL BALL BATS

BACKGROUND OF THE INVENTION AND PRIOR ART

1. Field of the Invention

The present invention relates to hollow bats primarily for softball and, more particularly, to metallic and composite hard shell bats. Such bats typically include a metal outer shell which may be formed of aluminum or titanium alloy or other metals or may be made of composite construction. As referred to herein, the terms "aluminum" and "titanium" are intended to encompass the metals and alloys and mixtures of metals and alloys formulated for the manufacture of bat shells.

2. Prior Art

Various methods of affixing end caps to the tubular barrel end of baseball bats are known. Typically, the end cap includes a cylindrical plug or skirt which is which may be cast in place or force fit so as to be closely received in the end of the barrel and affixed thereto by adhesive or by a mechanical interlock or both. See, for example the Heald U.S. Pat. No. 3,729,196 issued Apr. 24, 1973; the Wilson U.S. Pat. No. 3,735,473 issued May 29, 1973 and U.S. Pat. No. 3,811,596 issued May 21, 1974; the Pouzou U.S. Pat. No. 3,834,698 issued Sep. 10, 1974; and the Souders, et al U.S. Pat. No. 5,395,108 issued Mar. 7, 1995.

OBJECT OF THE INVENTION

The primary objective of the invention is to provide an end cap assembly for thin wall tubular baseball and softball bats, particularly aluminum bats, so that the thin wall barrel need not be machined or otherwise reconfigured to facilitate attachment of an end cap thereto.

SUMMARY OF THE INVENTION

The present invention provides an end cap assembly for closing the open end of a tubular ball bat having a thin generally cylindrical barrel wall, said assembly comprising a cylindrical sleeve sized to slidably and closely fit into the barrel of the bat, said sleeve providing an annular cap seat at one end of said sleeve, and an annular groove on an exterior annular surface of said sleeve for defining an annular glue chamber with said barrel, a glue fill port extending through said sleeve from the interior of said sleeve to said annular groove, said sleeve also having an internal annular recess for receiving an annular lock collar on a depending skirt of a bat end cap, said recess being axially spaced from said annular cap seat, and a bat end cap having an axially extending annular skirt and an annular lock collar on the exterior surface of said skirt, said collar being closely received in said annular recess in said sleeve for affixing said cap to said sleeve.

DESCRIPTION OF THE PREFERRED EMBODIMENT

A tubular baseball bat ordinarily includes a metal or metal alloy shell which may be of aluminum or other metals, a handle, a barrel and a tapered section interconnecting the handle and the barrel. A knob closes the handle end of the bat and an end cap is typically affixed to the barrel end of the bat as is well known.

Reduction of the wall thickness of the outer shell of a tubular bat desirably reduces the weight of the bat but undesirably increases the longitudinal flexibility thus absorbing a portion of the batter's energy which would otherwise be imparted to the ball and may result in permanent denting of the bat if the wall is too thin. Thinning of the wall of a metal shell bat desirably results in higher ball rebound velocity due to more significant flexing of the bat wall, commonly referred to as "trampoline effect". Composite shell bats and metal shell bats with resilient walls are intentionally designed to permit controlled localized flexing of the outer bat wall. The present invention is directed to affixation of the end cap to the newer thinner wall bats and, while primarily designed for aluminum bats, the teachings of the invention may be easily adapted to thin wall tubular bats of other metals or materials.

Figure 1:
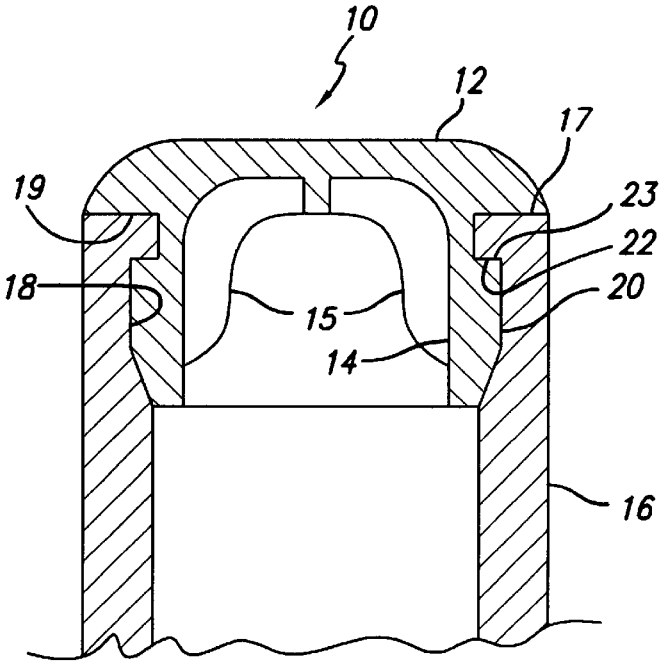
FIG. 1 PRIOR ART
FIG. 1 is a cross sectional view of the barrel end of a prior art bat having a urethane end cap affixed thereto.
Figure 3:
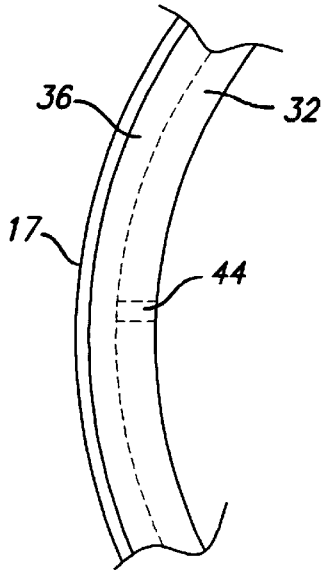
FIG. 3 is a substantially enlarged partial end view of the bat barrel and end cap affixation sleeve.

A bat and cap 10, which may be molded of a plastic such as urethane or formed of metal, includes a domed head 12 and an integral cylindrical skirt 14 which extends axially of the bat as seen in FIG. 1 into the end of the barrel 16 of the bat. Circumferentially spaced webs 15 radially support the skirt 14 which has an exterior taper 13 for assisting insertion of the end cap 10 into the barrel 16 of the bat. A mechanical lock between the end cap skirt 14 and barrel 16 is provided by machining or otherwise forming an annular recess 18 in the internal wall of the barrel so that an externally projecting annular lock collar 20 on the end cap skirt 14 can be snapped into the recess 18 to firmly affix the end cap to the barrel. Adhesive is typically also applied to meeting areas of the barrel 16 and end cap 10 for additional adhesion. As is seen in FIG. 1, the end 17 of a prior art bat barrel 16 is of sufficient wall thickness to provide a seat for engagement with an annular lip 19 on the underside of the head of the end cap for seating the lip 19 cap flush with the end 17 of the barrel. The axially abutting radially extending shoulders 22, 23 of the recess 18 and the lock collar 20 prevent axial movement of the end cap relative to the bat in a direction tending to detach the cap from the bat. Since a typical prior art aluminum bat has a barrel wall thickness in the range of 0.055" to 0.120", the wall of barrel 16 is of sufficient thickness to permit machining of the locking recess 18 without undue weakening of the bat.

Figure 2:
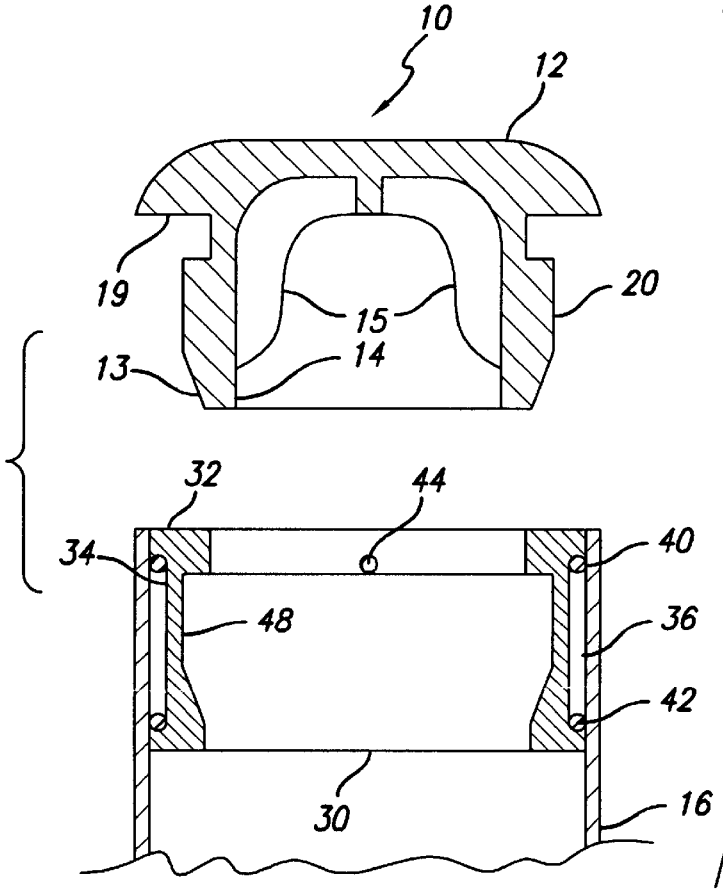
FIG. 2 is a cross sectional view of the barrel end of a thin wall bat and an end cap assembly according to the invention affixed thereto by adhesive.

With the newer thin walled bats having aluminum barrel walls in the range of 0.036–0.055 inches (for softball bats), machining of an annular groove in the internal surface of the barrel of sufficient depth to engage a locking collar on the end cap is impractical. Accordingly, a cylindrical end cap reception sleeve 30, preferably of aluminum, has been provided as shown in FIG. 2. The sleeve 30 has an outside diameter, at the top and bottom of the sleeve, sized to slidably and closely fit the sleeve into the barrel 16 of the bat. The upper end surface of the sleeve 30 thus is of sufficient width to provide an annular cap seat 32 of sufficient width to engage the radially extending lip 19 on the end cap 10 to prevent movement of the cap into the sleeve and into the barrel of the bat.

An annular groove 34 is provided on the exterior cylindrical wall of the sleeve 30 so that, when the sleeve 30 is slid into the barrel 16, the sleeve and bat barrel together define an annular glue chamber 36 for receiving liquid adhesive to adhere the sleeve firmly to the barrel. Preferably, the sleeve is machined with O-ring grooves at the top and bottom ends of the annular glue chamber for receiving rubber O-rings 40, 42 to resiliently seal the glue chamber. At least one, and preferably a plurality, of circumferentially spaced glue fill ports 44 extend through the sleeve 30 from the interior of the sleeve to the annular glue chamber 36.

The sleeve 30 also is provided with an annular groove 48 on its inside cylindrical surface for receiving the radially projecting annular lock collar 20 on the axially depending skirt 14 of the bat end cap, the internal groove 48 being of sufficient width and depth to closely receive and prevent the collar 20 from axially moving relative to the sleeve.

As is known in the art of bat manufacture, a bat end cap 10 such as one made of urethane, allows sufficient flexibility of the axially extending skirt 14 to permit insertion of the skirt into the sleeve 30, the inherent resilience of the skirt enabling snap fitting the radially projecting collar 20 into the annular groove 48 to firmly affix the end cap to the sleeve 30 after the sleeve 30 has been inserted into and adhesively affixed to the barrel 16 by injecting glue through the fill ports 44 to substantially completely fill the annular glue chamber 36. It will be noted that the above construction requires no machining of the barrel of a thin wall bat yet provides an efficient and easy to affix an end cap thereto.

Persons skilled in the art will appreciate that various modifications of the invention can be made from the above described preferred embodiment and that the scope of protection is limited only by the following claims. Also, those skilled in the art of bat manufacture will understand that the bat end cap assembly disclosed herein need not be limited to thin wall bats. Use of the cylindrical sleeve is also useful, for example, in the manufacture of other bats such as those which have inner sleeves of the same or of different materials such as carbon core bats or dual metal wall bats.

What is claimed is:

1. An end cap assembly for closing the open end of a tubular ball bat having a thin generally cylindrical barrel wall, said assembly comprising a cylindrical sleeve sized to slidably and closely fit into the barrel of the bat, said sleeve providing an annular cap seat at one end of said sleeve, and an annular groove on an exterior annular surface of said sleeve for defining an annular glue chamber with the barrel, a glue fill port extending through said sleeve from the interior of said sleeve to said annular groove, said sleeve also having an internal annular recess for receiving an annular lock collar on a depending skirt of a bat end cap, said recess being axially spaced from said annular cap seat, and a bat end cap having an axially extending annular skirt and an annular lock collar on the exterior surface of said skirt, said collar being closely received in said annular recess in said sleeve for affixing said cap to said sleeve.

2. The end cap assembly of claim 1, further comprising a pair of spaced O-rings respectively retained in axially spaced annular grooves on the exterior surface of said sleeve for sealing axially opposite ends of said glue chamber.

3. The end cap assembly of claim 1, wherein a plurality of said glue fill ports are provided at circumferentially spaced locations around said sleeve.

4. The end cap assembly of claim 1, wherein said end cap is made of urethane plastic and said sleeve is made of metal.

5. The end cap assembly of claim 4, wherein said sleeve is made of aluminum.

6. A tubular ball bat including an end cap assembly according to claim 1 assembled onto the open end of the barrel of the bat and affixed thereto by injecting glue through said fill port to substantially fill said glue chamber.

7. The bat of claim 6, wherein said barrel is made of aluminum and has a radial wall thickness at the barrel end not exceeding 0.060".

8. The bat of claim 7, further comprising a pair of spaced O-rings respectively retained in axially spaced annular grooves on the exterior surface of said sleeve sealing axially opposite ends of said glue chamber.

9. The bat of claim 8, wherein a plurality of said glue fill ports are provided at circumferentially spaced locations around said sleeve.

10. The bat of claim 9, wherein said end cap is made of urethane plastic and said sleeve is made of metal.

11. The bat of claim 10, wherein said sleeve is made of aluminum.

* * * * *